US008893444B2

(12) United States Patent
Richardson

(10) Patent No.: US 8,893,444 B2
(45) Date of Patent: Nov. 25, 2014

(54) ANCHORING SYSTEM WITH POST ANGULAR ADJUSTMENT

(75) Inventor: Brian Edward Richardson, Los Gatos, CA (US)

(73) Assignee: Imagine TF, LLC, Los Gatos, CA (US)

( * ) Notice: Subject to any disclaimer, the term of this patent is extended or adjusted under 35 U.S.C. 154(b) by 0 days.

(21) Appl. No.: 14/116,494

(22) PCT Filed: May 8, 2012

(86) PCT No.: PCT/US2012/036907

§ 371 (c)(1),
(2), (4) Date: Nov. 8, 2013

(87) PCT Pub. No.: WO2012/154724

PCT Pub. Date: Nov. 15, 2012

(65) Prior Publication Data

US 2014/0083025 A1 Mar. 27, 2014

Related U.S. Application Data

(60) Provisional application No. 61/518,762, filed on May 11, 2011.

(51) Int. Cl.

| | |
|---|---|
| ***E02D 27/42*** | (2006.01) |
| ***E02D 31/00*** | (2006.01) |
| ***E02D 27/50*** | (2006.01) |

(52) U.S. Cl.

CPC ..... *E02D 27/42* (2013.01); *E02D 31/002* (2013.01); *E02D 27/50* (2013.01)

USPC ..... 52/150; 52/126.1; 52/152; 52/165; 248/218.4; 248/227.3; 248/230.1; 248/516; 248/532; 248/533

(58) Field of Classification Search

CPC . E02D 27/42; E04H 12/2269; E04H 12/2276; E04H 12/2284

USPC ..... 52/126.1, 127.2, 149, 150–152, 158, 52/165; 248/226.11, 227.3, 218.4, 219.2, 248/230.1, 516, 532, 533

See application file for complete search history.

(56) References Cited

U.S. PATENT DOCUMENTS

| | | | |
|---|---|---|---|
| 254,350 | A | 2/1882 | Mann |
| 278,220 | A | 5/1883 | Carson |
| 289,149 | A | 11/1883 | Scott |
| 405,445 | A | 6/1889 | Thomson |

(Continued)

FOREIGN PATENT DOCUMENTS

| | | | | |
|---|---|---|---|---|
| DE | EP0355344 | B1 | * | 5/1992 |
| NL | 1001201 | C2 | * | 3/1997 |
| WO | WO 2010144944 | A1 | * | 12/2010 |
| WO | WO 2011086240 | A1 | * | 7/2011 |

*Primary Examiner* — Adriana Figueroa

(74) *Attorney, Agent, or Firm* — Thomas Schneck

(57) ABSTRACT

A post securing system that secures a post in the ground, while allowing for a full range of vertical adjustment via a coupling assembly that includes an articulating ball joint element that is connected to a post support element secured within two clamp assemblies. The clamp assemblies each include an anchor assembly which, when assembled, secures at least three stake elements at a predetermined angle. The post securing kit includes both the coupling assembly and the anchor assembly to allow securing a post into a non-horizontal ground, while maintaining the desired vertical alignment of the post held therewithin.

4 Claims, 15 Drawing Sheets

(56) References Cited

U.S. PATENT DOCUMENTS

| | | | | | |
|---|---|---|---|---|---|
| 589,763 | A | | 9/1897 | Thomson | |
| 716,749 | A | * | 12/1902 | Parker | 52/297 |
| 1,107,016 | A | | 8/1914 | Bailey | |
| 2,001,719 | A | | 5/1935 | Greene | |
| 3,142,464 | A | * | 7/1964 | Zelenitz | 47/40.5 |
| 3,195,696 | A | | 7/1965 | Stefan | |
| 3,195,697 | A | | 7/1965 | Case | |
| 3,676,965 | A | * | 7/1972 | Deike | 52/98 |
| 3,915,435 | A | | 10/1975 | Carey | |
| 4,541,601 | A | * | 9/1985 | Corbisello | 248/516 |
| 4,603,520 | A | | 8/1986 | Deike | |
| 5,002,252 | A | * | 3/1991 | Setala et al. | 248/533 |
| 5,346,315 | A | * | 9/1994 | Strong et al. | 384/192 |
| 5,395,184 | A | | 3/1995 | Gagliano | |
| 5,404,682 | A | | 4/1995 | West | |
| 5,791,635 | A | | 8/1998 | Hull | |
| 5,829,887 | A | * | 11/1998 | Strong et al. | 384/206 |
| 5,884,874 | A | | 3/1999 | Speece | |
| 5,927,677 | A | | 7/1999 | Speece | |
| 6,273,390 | B1 | | 8/2001 | Meyer | |
| 6,298,618 | B1 | | 10/2001 | Lawson | |
| 6,622,976 | B1 | * | 9/2003 | Ianello | 248/73 |
| 6,766,992 | B1 | * | 7/2004 | Parker | 248/300 |
| 7,219,872 | B2 | | 5/2007 | Walker | |
| 7,533,854 | B2 | * | 5/2009 | Aube | 248/95 |
| 2008/0104898 | A1 | | 5/2008 | Hill | |

* cited by examiner

ANCHORING SYSTEM WITH POST ANGULAR ADJUSTMENT

FIELD

The present system relates generally to post supports and anchor assemblies for posts, as well as to anchoring of structures and other physical objects and structures requiring anchoring.

BACKGROUND

Post or pole fixation is most often seen in securing fence posts in the ground. These applications require that the pole or post be vertically aligned with great accuracy; however, the ground into which these are secured, may not be level or may be against the side of a slope or hill. Because the poles or posts being utilized are typically long in relation to their thickness, it can be difficult to accurately align them.

One of the existing common methods utilized is to dig a hole and set the post in concrete. The post or pole can be aligned vertically with other posts or poles to keep the alignment while the concrete cures. In many cases, the position of the pole or post must also be constrained with additional posts or poles to maintain alignment during concrete curing. Generally, concrete must cure for several days, depending on weather conditions, before the post or pole is sufficiently fixed to be usable. This method, although labor intensive and time consuming, allows for exact vertical alignment of the pole or post. Thus, there is a need for a system that allows for the accurate alignment of posts or poles while requiring much less labor and time than the existing systems.

In addition, many post or poles used currently for fencing deploy wood directly in the earth or encased in cement. Both of these methods result in failure in a relatively short period of time. In some environments where moisture, freezing temperatures and insects are prevalent the time period is extremely short. Frost heave is a common problem in cold weather climates, in which the frozen ground effectively pushes out of the ground the concrete block that is securing a post. Thus, there remains a further need to an improved system for anchoring posts that minimizes costs, and enables the use of materials having long-term durability in a ranges of environments.

SUMMARY

The present system relates to post supports that can pivot at an angle sufficient to provide structural support for posts installed against a hillside or other non-level surface, as well as on level surfaces. The support may include an anchor assembly adapted to receive the pivotable post support, or other supports that may require secure anchoring.

The present system is used for anchoring fence posts, sign posts, flag posts, flag poles, or a post for any purpose that requires anchoring. As used in this document, the term "post" refers to both posts and poles, including fence posts, sign posts, flag posts, and flag poles, that are rounded or includes one or more squared edges, or any post, pole, or other substantially elongate item used for any purpose that requires essentially vertical anchoring. The present system is used to fix poles or posts into the earth for permanent construction or temporary applications.

An advantage of the present system is the ability to adjust the angular orientation of the post or pole after the stakes have been set into the earth. Another advantage of the present system is that a relatively small number of components are necessary to assemble the system, which conserves cost and reduces the amount of raw materials. A still further advantage of the present system is that the components are made of preferably galvanized steel for long life even in harsh conditions.

Accordingly, the present system is a post support assembly for receiving a post, comprising a post support structure adapted to receive an end of an elongated post extending along a post axis, an anchor assembly adapted for stable fixation in the ground at a geographic location, and a coupling assembly for coupling the post support structure to the anchor assembly by way of a ball joint element and associated clamp assembly. In this system, a post received by the post support is adjustably positionable to establish the post axis to a desired angle with respect to local gravity at the geographic location.

In an embodiment of the present system, the coupling assembly further comprises a ball joint element extending along a post axis between a support end and a post end, wherein the support end has an outer surface disposed about a center point CP on the post axis, and characterized by a radial distance from CP less than or equal to $R_0$. The outer surface of the ball joint element includes an outer surface region that includes one or more spherical segments centered about CP and being a radial distance $R_0$ from CP, and the outer surface region extends between angle A1 and angle A2. The spherical segments may be contiguous to form an outer surface having a solid spherical shape, or the surface may be striated or variegated with holes. In an embodiment, A1 is an upper limit angle between an upper limit point of the spherical segment on a first side of a reference plane orthogonal to the post axis and passing through CP, wherein A1 is greater than 0° and less than 90°, and A2 is an lower limit angle between a lower limit point of the spherical segment on a second side of the reference plane, wherein A2 is greater than 0° and less than 90°.

The system further comprises a post support element extending between a ball end and the post end, wherein the ball end is affixed to the ball joint element at a point on the outer surface of the ball joint element at an angle greater than A1 with respect to the reference plane.

In another embodiment, the coupling assembly is a clamp assembly. The clamp assembly includes: (i) an upper clamp element, including a planar region having a central aperture therein disposed about an upper clamp axis orthogonal to the planar region, wherein the central aperture includes a circumferentially dispersed circular segment having a radius $R_{UC}$ is greater than $R_{UC}$ cos A1, and $R_{UC}$ greater than or equal to $R_{UC}$ otherwise; (ii) a lower clamp element, including a planar region having a central aperture therein disposed about a lower clamp axis orthogonal to the planar region, wherein the central aperture includes a circumferentially dispersed circular segment having a radius $R_{LC}$ is greater than $R_{LC}$ cos A1, and $R_{LC}$ greater than or equal to $R_{LC}$ otherwise; and (iii) a clamp coupler, including at least three bolt assemblies adapted to adjustably couple the upper clamp element to the lower clamp element with the upper clamp element disposed with its central aperture extending about a portion of the spherical regions on one side of the reference plane, and the lower clamp element disposed with its central aperture extending about a portion of the spherical regions on the other side of the reference plane.

In this embodiment, the anchor assembly further comprises a plurality of elongated anchor elements extending from at least one of the upper clamp element and the lower clamp element and in a direction away from the upper clamp element. These anchor elements secure the anchor assembly into the ground, and preferably are elongate rigid stakes.

Upon assembly, the post support system includes a post extending along a post axis between a support end and a distal end, wherein the support end of the post axis extends from and is integral with the support end of the post support element, and the post axis is coaxial with the post axis. Alternatively, the support end of the post axis is adapted to slidingly engage the support and of the post support element, whereby the post axis is coaxial with the post axis.

The present anchor element for an anchor and support assembly, comprises a first anchor plate, wherein the plate is a sheet element having a uniform thickness D, and having a planar central portion with a nominal periphery P, and extending along and about a principal plane transverse to a central axis. The sheet element includes a coupling region disposed about the central axis and within the central region, and at least three elongated tab elements, each tab element extending along an associated tab axis from the nominal periphery P, from a proximal portion at a proximal end thereof to a distal end, wherein a principal plane of the proximal portion extends along and is parallel to the principal plane. The tab axes are co-planar and are transverse to and extend radially outward from the central axis, and each tab element includes, at its distal end, a capture bend region, whereby the tab axis of a distal portion of the tab element extends from an intermediate point, away from the principal plane in a first direction, and thereafter extends toward and across the principal plane in a second direction to the distal end. Each tab element includes a primary bend region between its proximal portion and the intermediate point, whereby a distal portion of the tab element extending from the intermediate point to the distal end extends transverse to the tab axis in a direction perpendicular to the principal plane, between a first lateral edge on one side of the principal plane and a second lateral end on the other side of the principal plane. Each distal portion includes a slot having a predetermined width D extending from the first lateral edge into the distal portion along an associated slot axis parallel to and a distance S from the central axis.

In an alternative embodiment, the anchor element includes a structure for coupling the coupling region to an externally applied element. In an embodiment, the tab elements are equi-angularly disposed about the central axis.

As described herein, the present anchor and support assembly kit comprises a first anchor plate, and a second anchor plate, as described above. The kit further includes a set of fastening elements adapted to clamp the first anchor plate to the second anchor plate with distal portions of opposite tab elements disposed within corresponding slots, and a set of elongated anchor elements, each anchor element being associated with a tab element, and wherein each anchor element extends from a proximal end to a distal end, wherein the proximal and is adapted for capture between oppositely positioned bend regions of the plus first anchor plate and the second anchor plate when positioned opposite each other with the fastening elements.

These and other objects and advantages of the present invention will become apparent to those skilled in the art in view of the description of the best presently known mode of carrying out the invention as described herein and as illustrated in the drawings.

DETAILED DESCRIPTION

Figure 1:
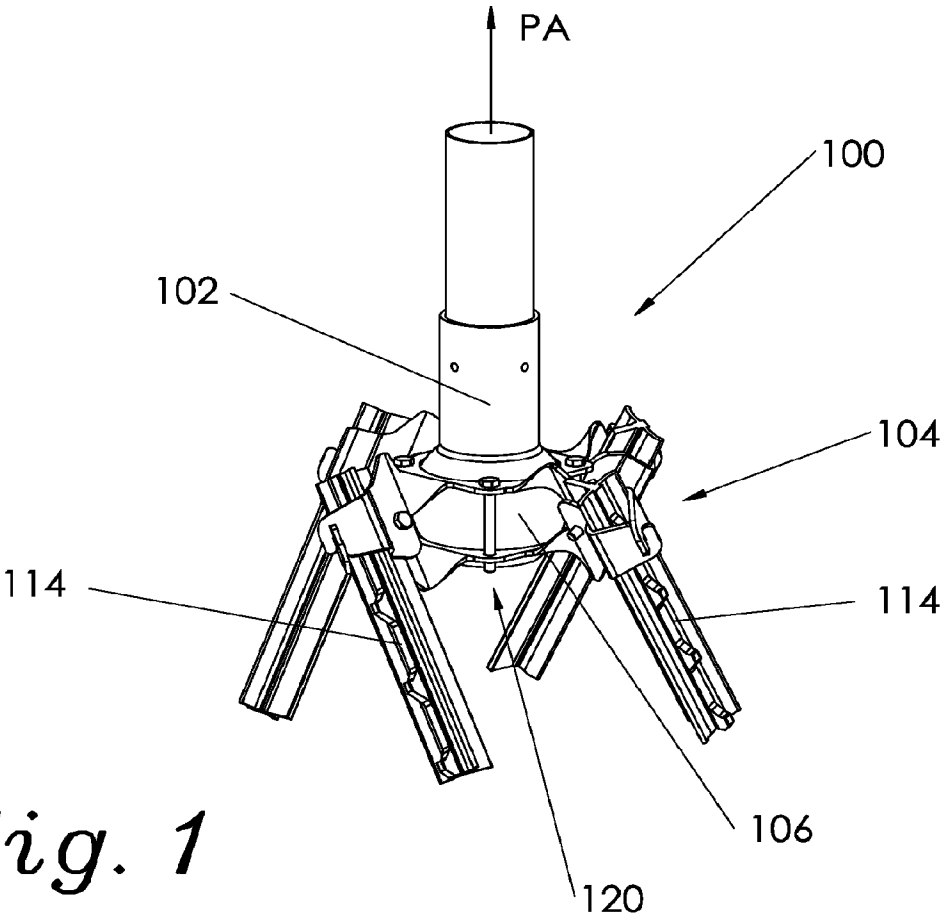
FIG. 1 is a perspective representation of an embodiment of the present post anchor system.

The present post support assembly 100, as shown in FIG. 1, includes a post support element 102 that is coupled to an anchor assembly 104 by coupling assembly 120 for fixing a post, as defined above, into the ground. One benefit of the present assembly 100 is that the post support element 102 is coupled to the anchor assembly 104 in such as way that the post support element 102 can rotate within the coupling assembly 120 in a manner that allows an attached post to be anchored into the side of a hill, while maintaining an accurate vertical orientation of the post.

Figure 2A:
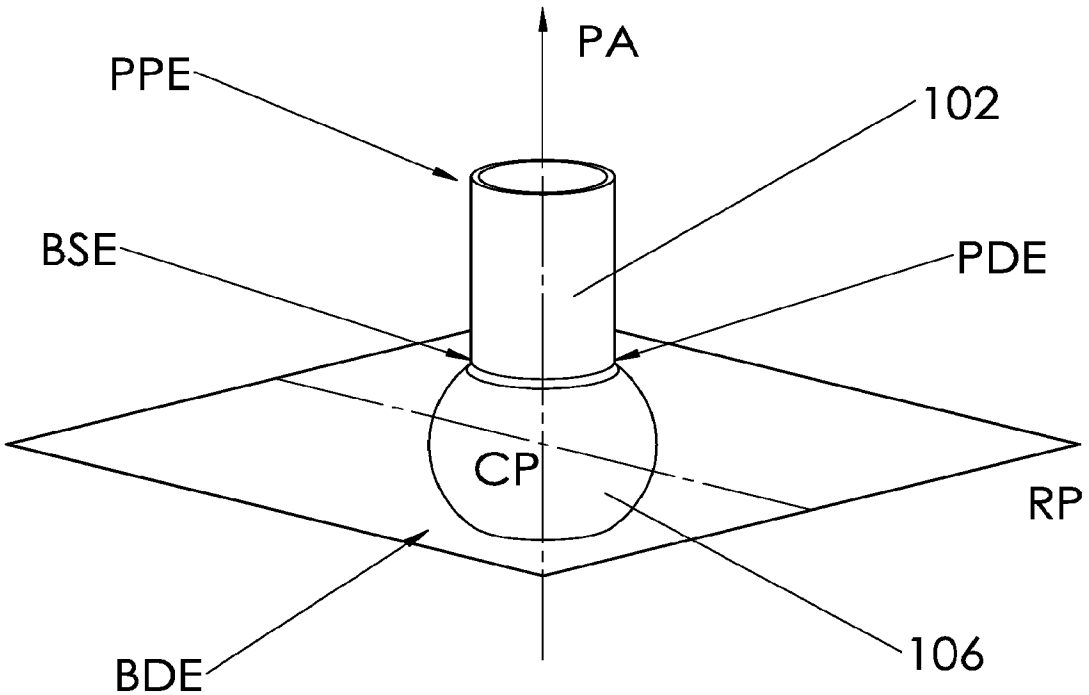
FIG. 2A is a perspective view of an embodiment of the ball joint and post support elements of the present system.
Figure 2B:
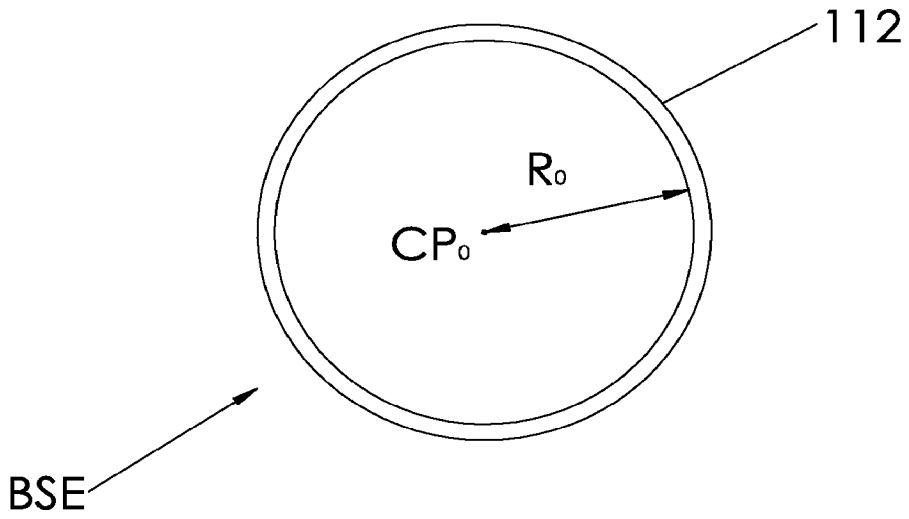
FIG. 2B is a top cross-section view of an embodiment of the ball joint element of the present system.

As shown in FIG. 2A, the coupling assembly 120 includes a ball joint element 106 extending along a post axis PA between a ball distal end BDE and a ball support end BSE. The ball joint is integral with or otherwise attached to a post support element 102 that also extends along the post axis PA between the post proximal end PPE and the post distal end PDE. The ball joint element is attached to or integral with the post support element at the junction of the ball support end and the post distal end. The outer surface of the ball joint element 106 is disposed about a center point CP on the post axis PA, along a reference plane RP. As shown in cross-section in FIG. 2B, the ball support end BSE has an outer surface 112 disposed about a center point CP on the post axis PA, and is characterized by a radial distance from the center point CP less than or equal to radius $R_O$.

In an embodiment, the outer surface of the ball joint element 106 includes an outer surface region, which preferably is a solid surface. In alternate embodiments, the surface may be formed from separate segments or may be striations or variegated with holes on the surface itself. The ball element may be a solid structure, or may be hollow, provided that the materials with which the ball joint element is manufactured is sufficiently strong to support a post of the desired dimensions. Thus, the thickness of the ball joint may vary from solid to several millimeters, depending on the intended use of the ball joint. The ball joint element 106 may be spherical, or may have an essentially spherical shape, depending on the specific application. Alternatively, the element 106 may include multiple segments that are manufactured from the same or different materials from the center of the element 106. The ball joint element 106 may be integral with the post support element 102, or may otherwise be affixed to the post support element 102, for example by welding. The ball joint element 106 preferably is manufactured from a rigid material, such as steel or aluminum, and may be manufactured using standard manufacturing methods, such as die casting.

Figure 3:
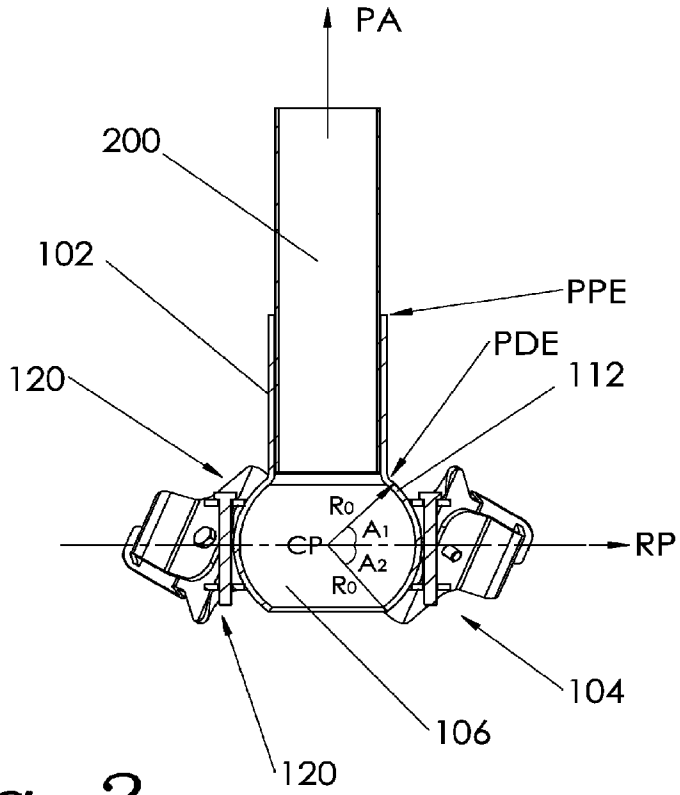
FIG. 3 is a side cut-away view of the ball joint and post support elements of the present system.

As shown in the cut-away view of the present system 100 in FIG. 3, the outer surface region 112 is a spherical segment centered about CP and a radial distance from $R_o$ from CP. The outer surface region extends between angle $A_1$ and $A_2$, wherein $A_1$ is an upper limit angle between an upper limit point of the spherical segment on a first side of the reference plane RP that lies orthogonal to the post axis PA and passes through center point CP. Angle $A_1$ is greater than 0° and less than 90° with respect to the reference plane RP. In addition, angle $A_2$ is a lower limit angle between a lower limit point of the spherical segment on a second side of the reference plane RP, wherein $A_2$ is greater than 0° and less than 90° with respect to the reference plane RP.

The coupling assembly 120 includes an elongate post support element 102 extending along the post axis PA between the post proximal end PPE and the post distal end PDE. The post distal end PDE is affixed to the ball joint element 106 at a point on the outer surface 112 of the ball joint element 106 substantially along the post axis PA. Such fixation may be achieved through welding, screws, or other secure method known in the field. The size, diameter, and shape of the post support element 102 varies depending on the size, diameter, and shape of the post element which mounts onto the support element 102. Thus, the support element 102 may be adapted to accept a post of any diameter or shape, or example a round pole, or a square post.

In the embodiment shown in FIG. 3, a hollow post 200, such as a type used for installing cyclone fences and the like, may be inserted into or onto the post support element 102. The ball joint element 106 is secured between two plates of a clamp assembly 120, as described in further detail below, such that in practice, the post support element 102 can rotate as necessary to maintain the post 200 in an accurate, predetermined alignment relative to the ground.

Figure 4:
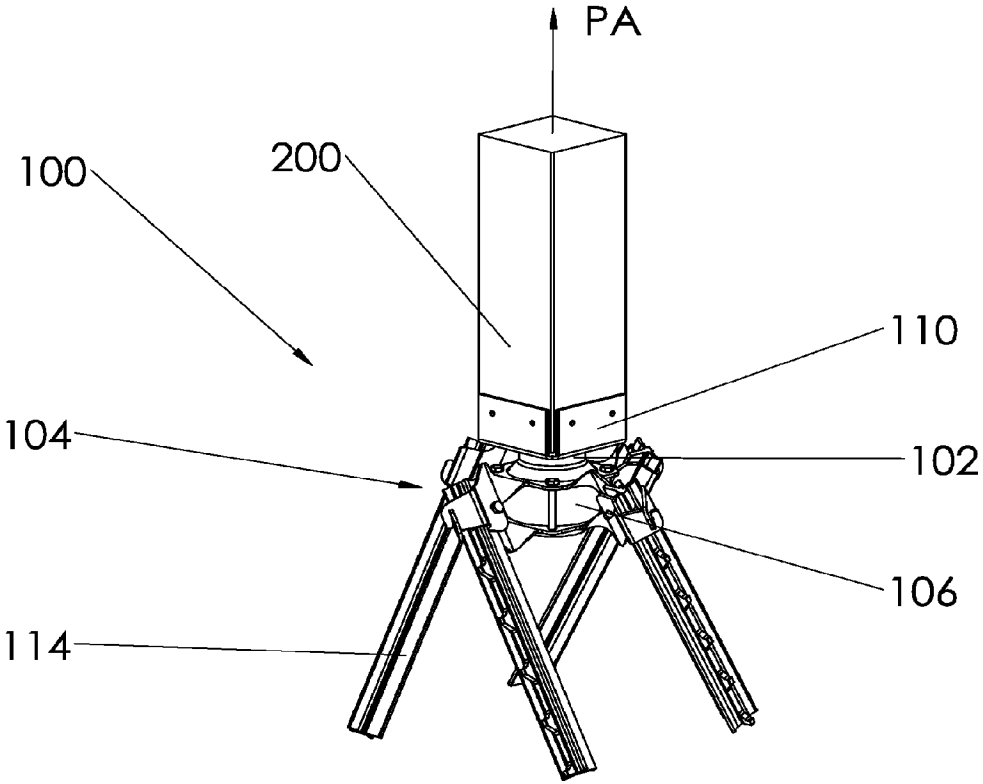
FIG. 4 is a perspective view of an embodiment of the present system.

FIG. 4 shows an alternate embodiment of the present post anchoring system 100 wherein the post support element 102 further includes support brackets 110 attached to or integral with the support element 102. The brackets 110 are spaced apart along and extend vertically parallel with the post axis PA to securely receive a post 200. The number, height, thickness, and shape of the brackets 110 depends on the height, weight, and shape of the post 200. The brackets 110 preferably are manufactured from a rigid material, such as steel or aluminum, and may be pressed and formed from a single sheet of material, or securely welded or otherwise attached to a base. Such a system can be used to secure solid posts, which cannot be inserted on top of the post support element described above.

Figure 5:
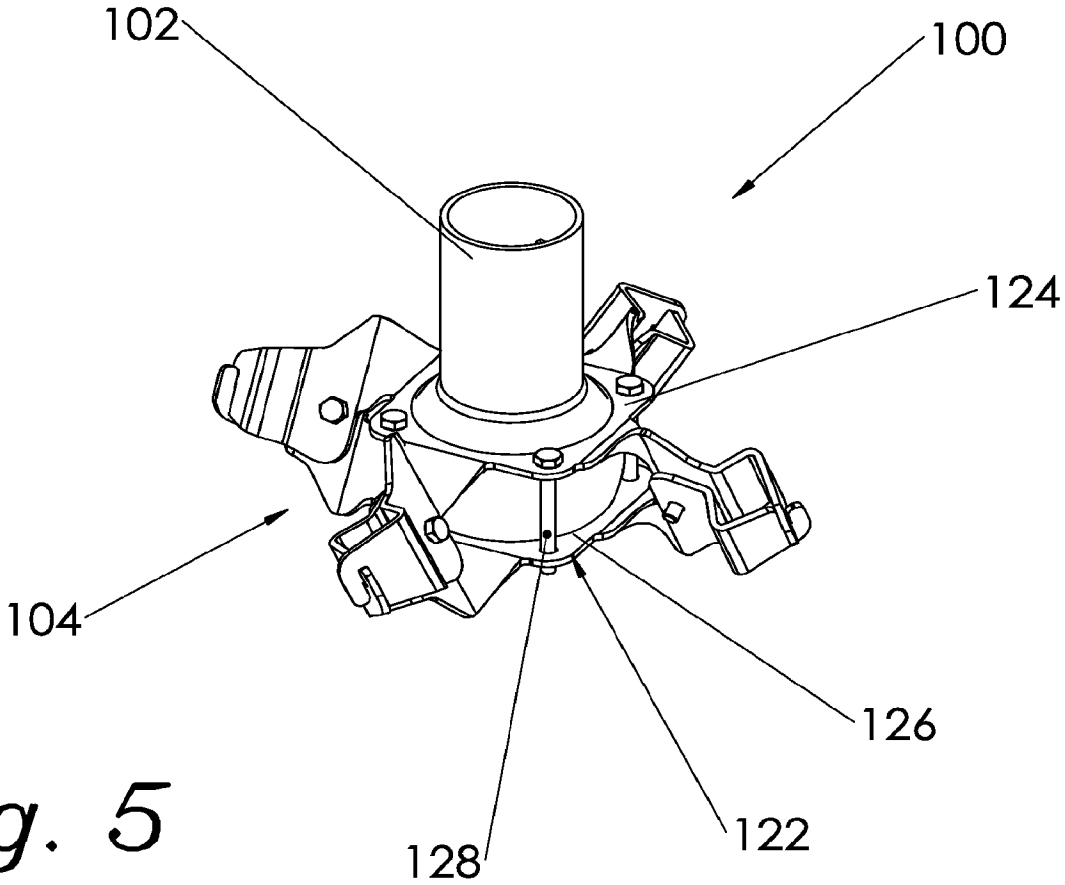
FIG. 5 is a perspective view of an embodiment of the coupling assembly of the present system.

The present system 100 further includes a clamp assembly 122, as shown in FIG. 5. The clamp assembly 122 has an upper clamp element 124 and a lower clamp element 126, together with one or more fastening elements or clamp couplers 128. The couplers 128 may be bolts, or other securing couplers as generally commercially available.

Figure 6A:
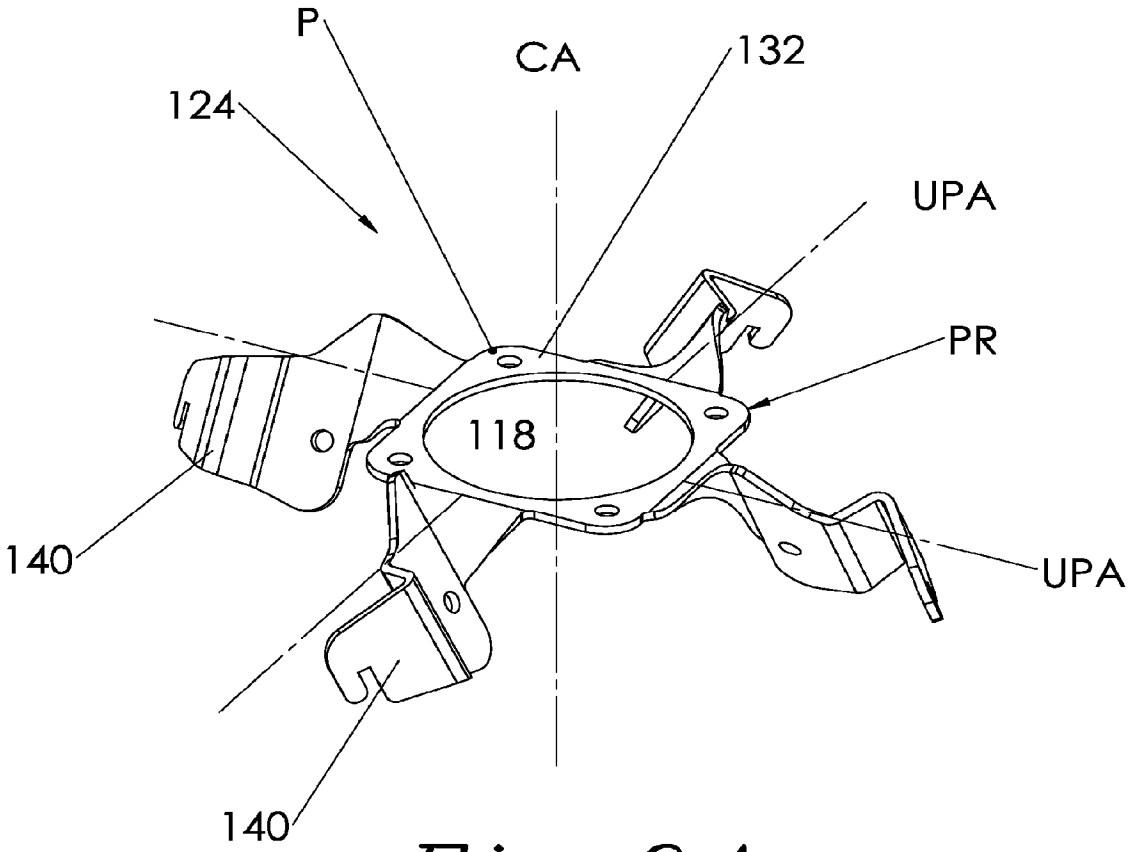
FIG. 6A is a side perspective view of an embodiment of an upper clamp element of the present system.
Figure 6B:
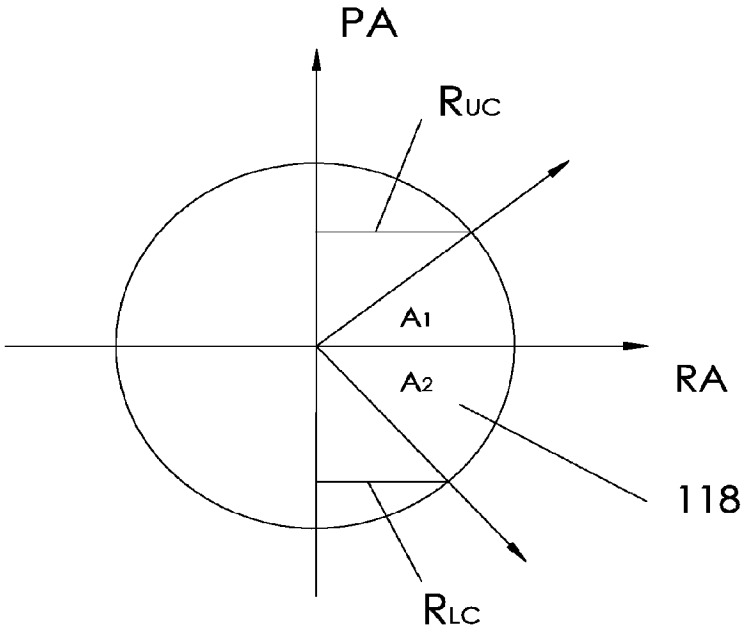
FIG. 6B is a graphic representation of the dimensions of an embodiment of an upper central aperture.

As best shown in FIG. 6A, the upper clamp element 124 includes a planar region PR having a central aperture 118. In the illustrated embodiment, the central aperture 118 is contiguous and spherical in shape. In alternative embodiments, the aperture may be non-spherical due to manufacturing design, cost, and the like. In yet another embodiment, the aperture may be formed by segments or otherwise non-contiguous. As shown in FIG. 6B, the aperture 118 has a radius $R_{UC}$ that is greater than $R_{UC} \cos A_1$, such that the radius of a corresponding ball joint element 106 fits within the aperture 118 without passing fully through the aperture 118. In this manner, the ball joint element 106 can be held by the aperture while being able to rotate freely within the aperture.

The upper clamp element 124 preferably is made of a sheet of rigid material having a uniform thickness D, of about 3 mm, depending on the nature of the intended use. Larger posts will require greater thickness D. The element 124 includes a planar central portion 132 having a nominal periphery P, and extends along and about the planar region PR along an upper plate axis UPA transverse to the central axis CA. In an embodiment, the clamp assembly 122 includes an anchor assembly 104 for securing structural stake elements 114 (shown in FIG. 4), which allows the clamp assembly to be used for securing posts in the ground. The anchor assembly 104 may be integrally formed from the planar central portion 132, or may otherwise be welded, or attached to the planar central portion 132.

Figure 7:
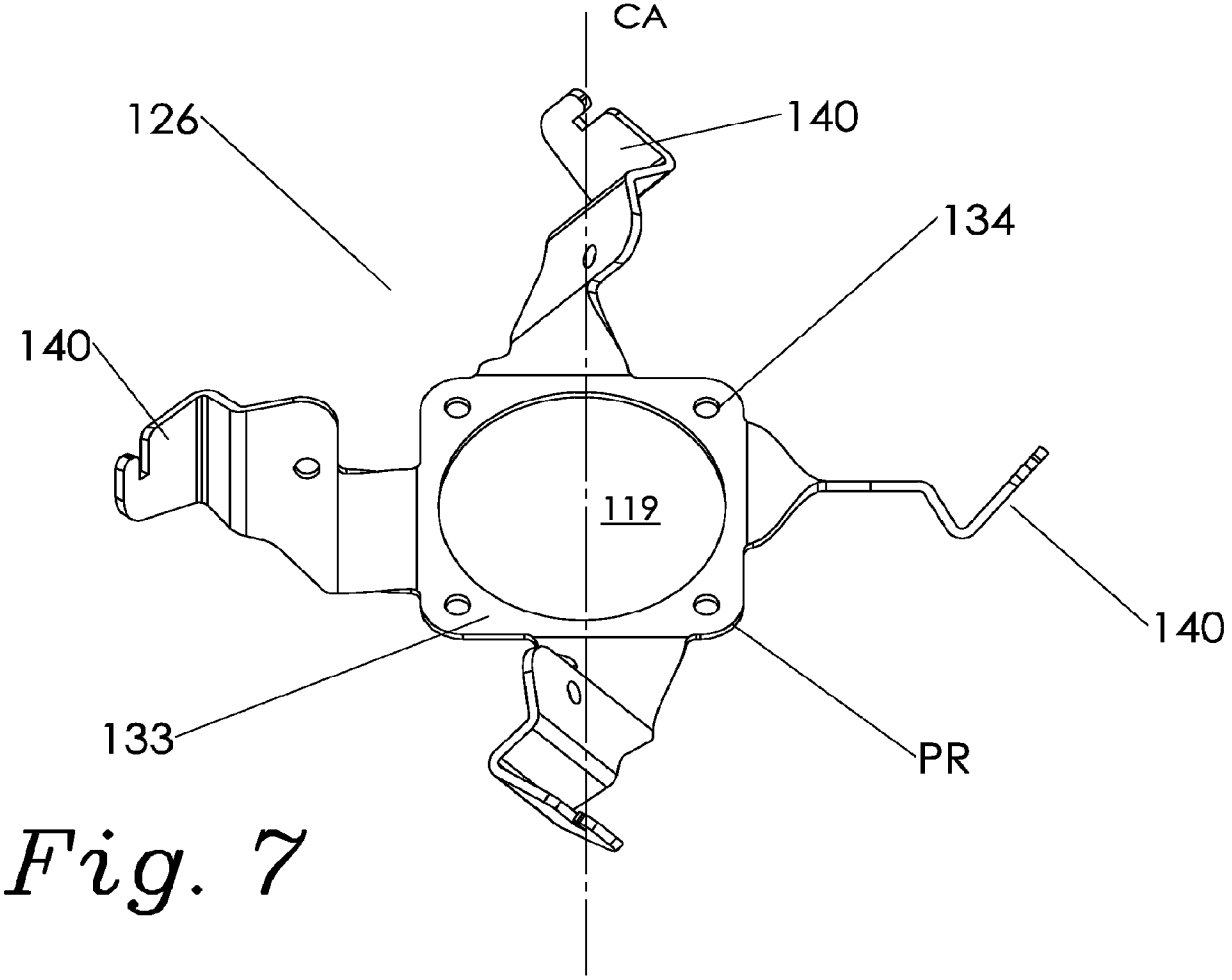
FIG. 7 is a top perspective view of an embodiment of a lower clamp element.

FIG. 7 shows a lower clamp element 126, which includes a planar region PR having a central aperture 119. As with the upper clamp element, it is possible for the aperture 119 to be non-spherical due to manufacturing design, cost, and the like. The central aperture 119 of the lower clamp element 126 is not required to be, but may be the same dimension as the central aperture 118 of the upper clamp element 124. In different embodiments, the central aperture of the upper clamp element and the lower clamp element are the same and one or the other or both elements may include separate circular segments. Alternatively, one clamp element may have contiguous circular segments, while the other clamp element may include multiple separate circular segments. Each such segment has a radius $R_{UC}$ that is greater than $R_{UC} \cos A_1$, such that the radius of a corresponding ball joint element 106 fits within the aperture 119 without passing fully through the aperture 119.

The lower clamp element 126 preferably is made of a sheet of rigid material having a uniform thickness D, of about 3 mm, depending on the nature of the intended use. Larger posts will require greater thickness D. The element 126 includes a planar central portion 133 having a nominal periphery $P_2$, and extends along and about the planar region PR along an upper plate axis UPA transverse to the central axis CA. In an embodiment, the clamp element 126 includes an anchor assembly 104 for securing structural stake elements 114 (as shown in FIG. 4), which allows the clamp assembly to be used for securing items in the ground. The anchor assembly 104 may be integrally formed from the planar central portion 132, or may otherwise be welded, or attached to the planar central portion. The clamp element 126 includes one or more coupler holes 134 positioned adjacent the central aperture 118 and of sufficient size to receive fastening elements 128 therethrough.

Figure 8:
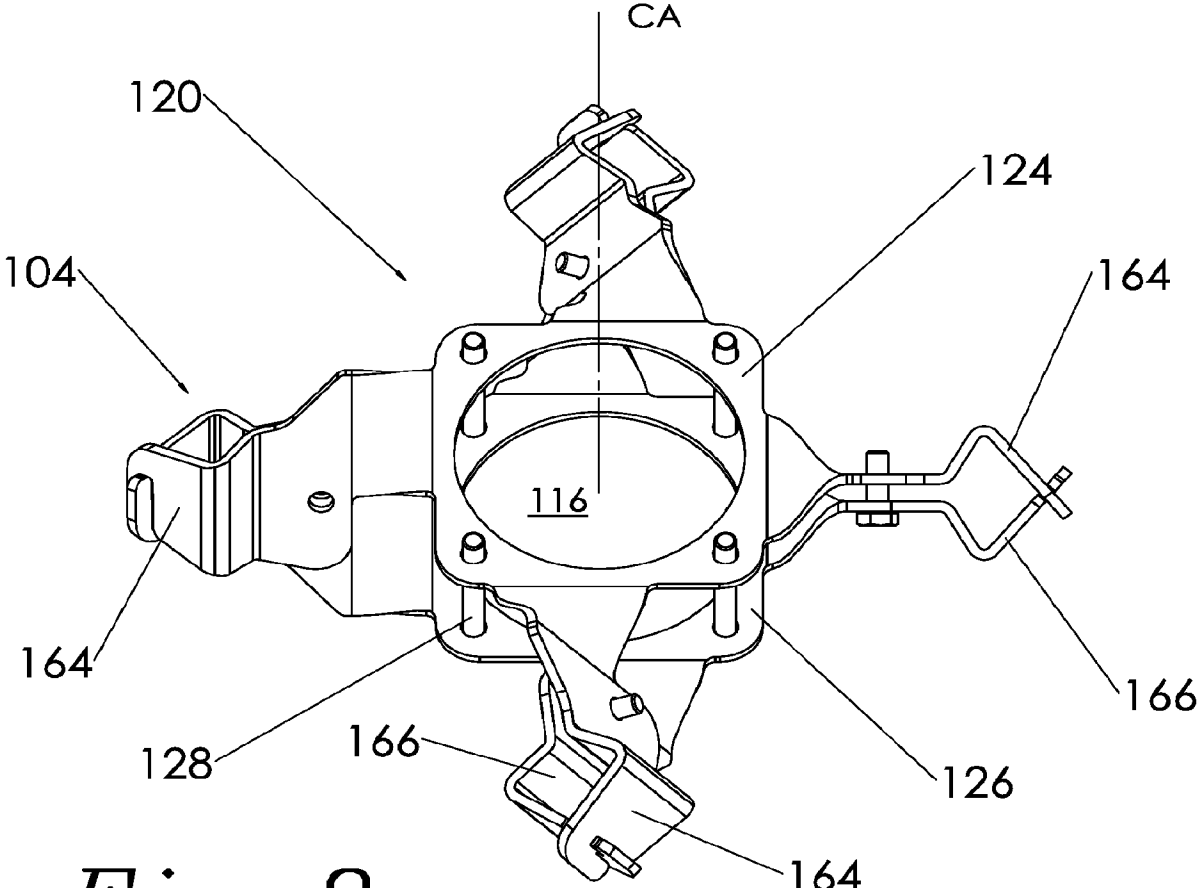
FIG. 8 is a top perspective view of an embodiment of a coupling assembly of the present system.

As shown in FIG. 8, the coupling assembly 120 includes an upper clamp element 124 that combines with a lower clamp element 126, and are secured by clamp couplers 128. When coupled as illustrated, the assembly 120 forms a central aperture 116 that extends therethrough along the central axis CA. In use, the coupling assembly 120 includes an anchor assembly 104 for structural stake elements 114, as described in further detail below.

In practicing the present coupling assembly 120, a post 200 is positioned and secured on the support element 102 while the attached ball joint element 106 is placed between the upper clamp element 124 and the lower clamp element 126. The clamp elements 124, 126 are held together using two or more fastening element, to securely and rotatably engage the ball joint element 106 therebetween. The post 200 then may be rotated into the desired vertical position.

Figure 9:
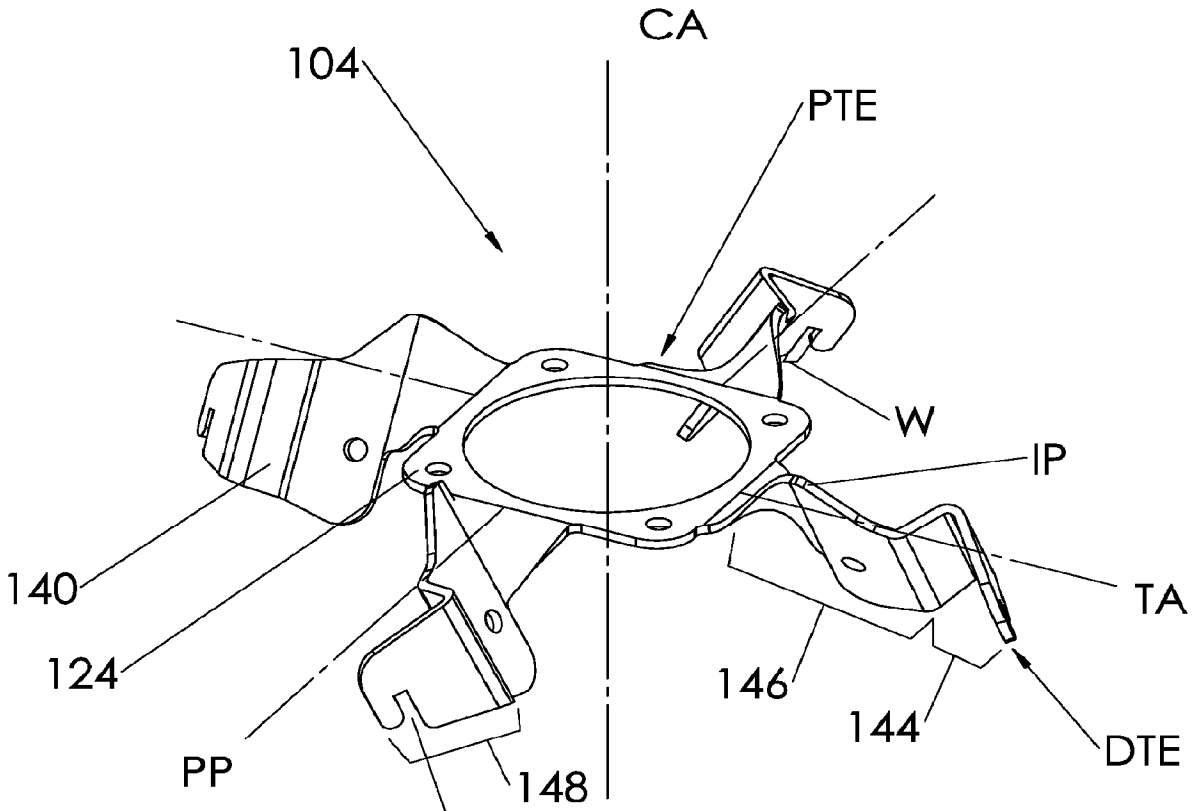
FIG. 9 is a side perspective view of an embodiment of an anchor assembly of the present system.

The present post support assembly 100 further includes an anchor assembly 104. In the illustrated embodiment of FIG. 9, the anchor assembly 104 is made from a single sheet of rigid material, which forms the upper clamp element 124, as described in detail above, and at least three elongate tab elements 140. Each tab element 140 extends along an associated tab axis TA from the nominal periphery P. Each tab element 140 thus extends from a proximal portion 142 at a proximal tab end PTE to a distal tab end DTE, wherein a principal plane of the proximal portion 142 extends along and is parallel to the principal plane PP.

The tab axes TA are co-planar to, transverse to, and extend radially outward from the central axis CA. Each tab element 140 includes at its distal tab end DTE a capture bend region 144, defined by the tab axis of a distal portion 148 of the tab element extends from an intermediate point, away from the principal plan in a first direction, and then extends toward and across the principal plane in a second direction to the distal tab end DTE. This forms an essentially S-shaped distal tab end DTE. In addition, each tab element includes a primary bend region 146 between its proximal portion 142 and the intermediate point IP on the tab, whereby the proximal portion is twisted to a degree between 0° and 90° relative to the tab axis. The twist effectively results in the distal portion 148 extending from the intermediate point IP to the distal tab end DTE such that it extends transverse to the tab axis in a direction perpendicular to the principal plane, between a first lateral edge on one side of the principal plane and a second lateral edge on the other side of the principal plane.

The distal portion 148 of each tab element 140 further includes a slot 150 having a predetermined width W extending from the first lateral edge into the distal portion along an associated slot axis parallel to and a distance S from the central axis CA.

As shown in FIG. 8, when the upper clamp tab elements 164 are twisted in accordance with the above on the upper clamp element 124, and the corresponding lower clamp tab elements 166 on a lower clamp element 126 are twisted in the corresponding dimensions, then the slots 150 of the each tab element align and interlock to form a secure anchor element assembly 104.

Figure 10:
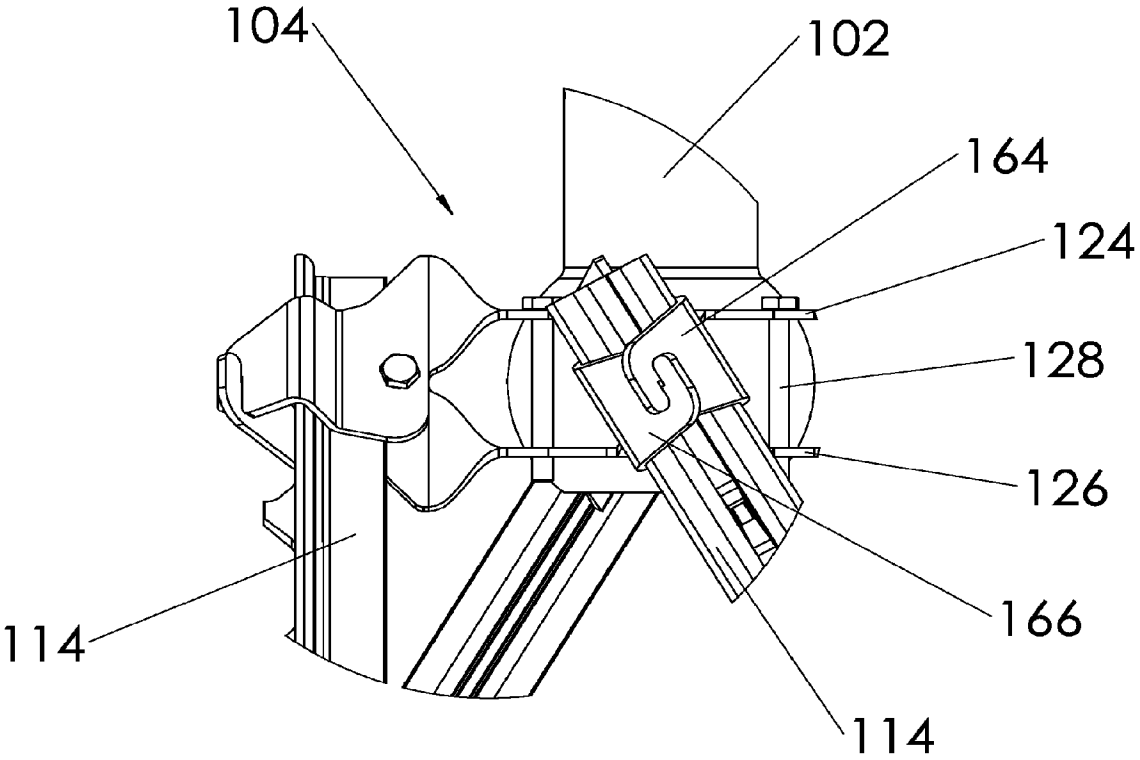
FIG. 10 is a side close-up view of an embodiment of an anchor assembly of the present system.

Rigid structural stake elements 114 are inserted, or otherwise secured in the space created between the capture bend regions 146 of each pair of complimentary tab elements 140, as shown in FIG. 10. The stakes 114 are set at a predetermined angle, which may be in the range of 0° to 45° from vertical, which is determined by the angle at which the capture bend region is bent. By thus being angled, the stakes 114 transfer the load from the post 200 to the ground, making the entire system 100 secure.

Figure 11:
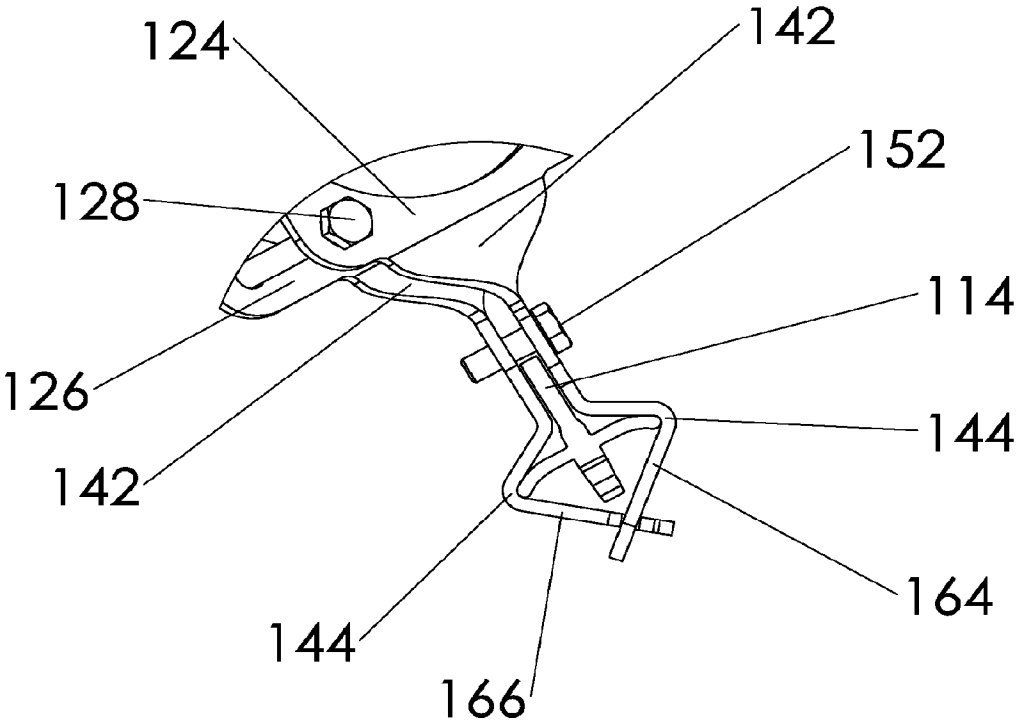
FIG. 11 a side diagrammatic view of an embodiment of the anchor assembly of the present system.

As shown in FIG. 11, once the upper clamp tab element 164 and lower clamp tab element 166 are secured around the structural stake elements 114, a secondary clamp coupler 152 may be applied to further secure the two tab elements together.

The anchor assembly 104 preferably is manufactured from a rigid metal, such as steel, and is adapted, as described below, to receive stakes 114 manufactured from rigid steel, aluminum, or other materials commonly used. In a preferred embodiment, the stakes 114 are standard "T" bar fence posts, readily commercially available and relatively inexpensive.

Figure 12:
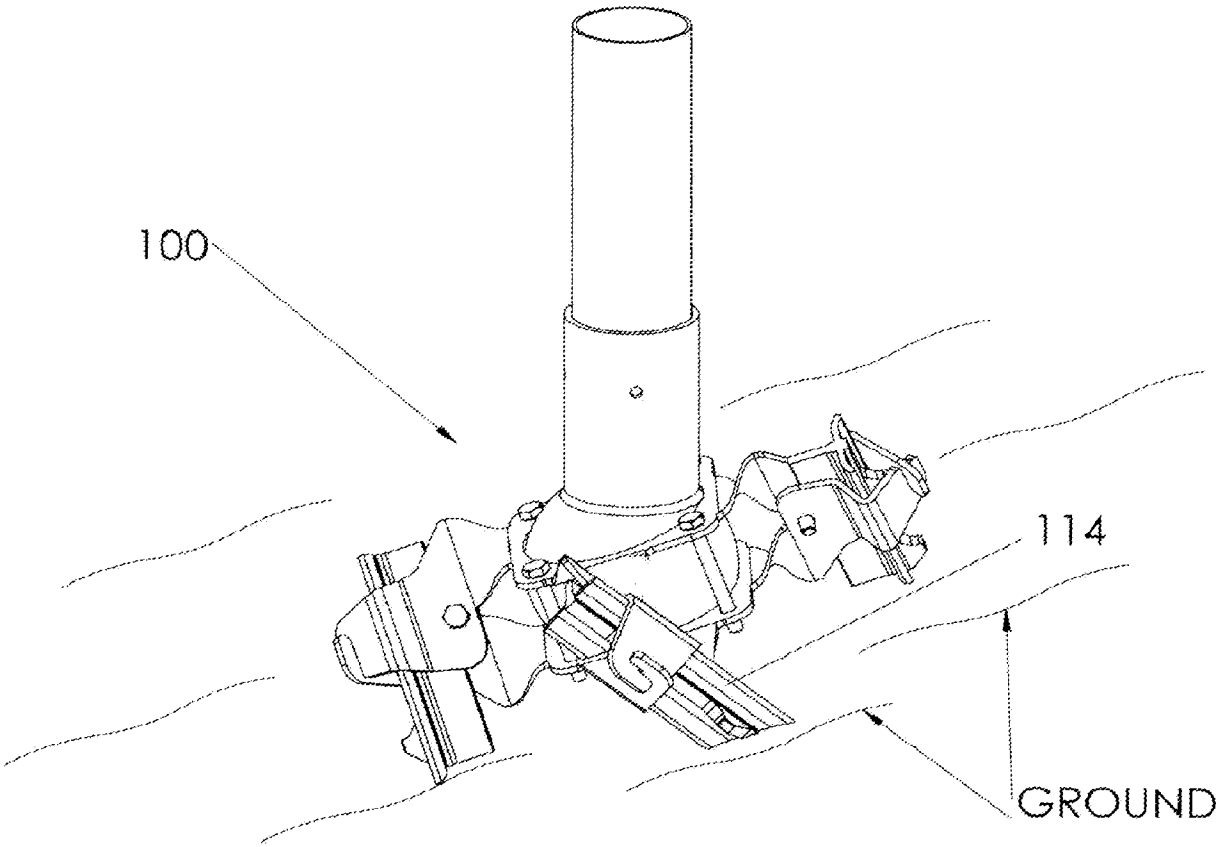
FIG. 12 is a perspective view of an embodiment of the present system angled for installation into non-level ground.

When using the present post securing system 100, and as shown in FIG. 12, the structural stake elements 114 are driven into the ground using conventional installation methods known in the art, and may further be secured by embedding the stakes in cement or other secure curing material. The structural stakes 114 are preferably arranged in a pattern where the load is spread over a large volume of the ground. In the illustrated embodiment, four stakes 114 are shown in a radial array around the center point CP. For low stress applications, the array include only two or three structural stakes 114. For extremely high stress applications, five or more structural stakes 114 may be deployed. A preferred embodiment utilizes a maximum of four structural stakes 114. The length and cross sectional size of the structural stakes 114 may be increased or reduced to match the requirements of the specific application. The cross-sectional shape of the illustrated structural stakes 114 is shown as a "t". This particular cross section is commonly used for wire type fencing. It should be noted that other shapes could be deployed as well as hollow tubing type sections.

Once the system 100 is installed, loosening the clamp couplers 128 releases the tension hold of the ball joint element 106 from between the two clamp elements, allowing a user to adjust the angular orientation of the post 200 secured therewithin without compromising the security of the position of the post in the system 100. Thus, the angle of the post 200 can be maintained at an accurate angle relative to the ground. This allows the system 100 to be installed against a hill, and the ball joint element 106 can be rotated to maintain the accurate alignment of the post 200 in a vertical position relative to the ground, if desired. The angle of the ball joint element 106 and post 200 can be altered at initial deployment of the system 100 or at a later date to readjust the orientation. Such ability to pivot the post 200 within the system 100 makes the installed post 200 more resilient to accidental impacts that otherwise would lift the installation assembly out of the ground. In such an accident, using the present system 100, the ball joint element 106 rotates with the impact, and absorbs most of the power of such an impact, leaving the system 100 essentially in the ground. The post 200 then merely needs to be realigned, without having to remove or replace the entire system 100.

The system 100 may be assembled, e.g., as shown in FIG. 5, for commercial sale, or it may be sold in separate components.

EXAMPLE

Figure 13:
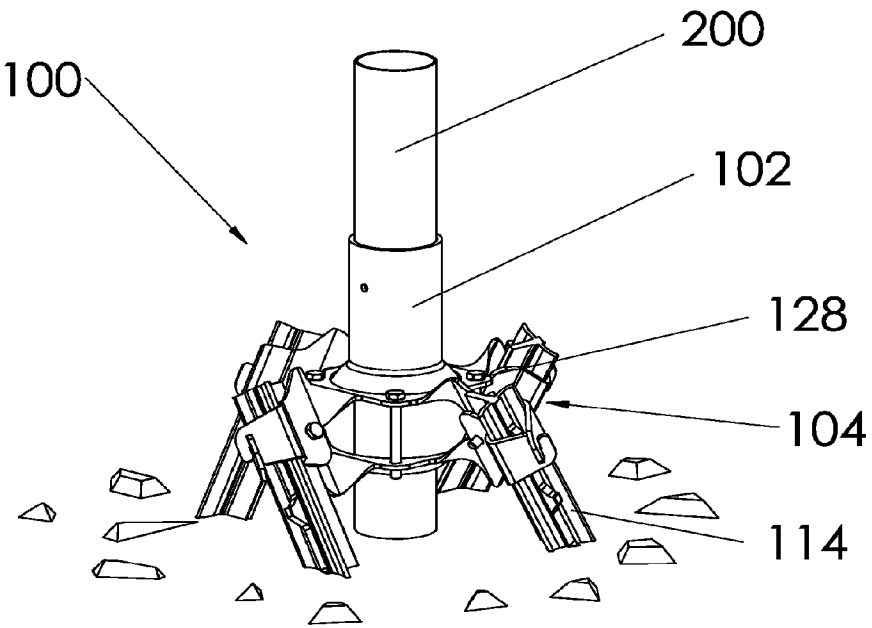
FIG. 13 is a perspective view of an exemplary embodiment of the present system, having a post that is driven into the ground.

As illustrated in FIG. 13, in using the present system 100, the system is placed on the earth in the desired area. The structural stakes 114, of the desired length, are then driven until flush with the planar region of the upper clamp element. The structural stakes 114 are driven with a sledge hammer or similar implement, including a number of commercially available electric or pneumatic drivers available that are specifically designed to drive stakes. The clamp couplers 128 are then tightened to secure the anchor assembly 104. The post 200 is then inserted on the post support element 102. The pole 200 is then leveled to vertical and the clamp couplers 128 are tightened further.

In some installations of round chain link fencing or sign posts/poles, the post/pole once leveled to vertical may be driven to further secure the installation. In some cases, this may be dictated by local building codes.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. An anchor element for an anchor and support assembly, comprising an upper clamp element, wherein the clamp element is a sheet element having a uniform thickness D, and having a planar central portion with a nominal periphery P, and extending along and about a principal plane along an upper clamp axis transverse to a central axis, wherein the sheet element has:

A. a coupling region disposed about the central axis and within the central portion, and B. at least three elongated tab elements, each tab element extending along an associated tab axis from the nominal periphery P, from a proximal portion at a proximal end thereof to a distal tab end, wherein a principal plane of the proximal portion extends along and is parallel to the principal plane, i. wherein each of the tab axis is co-planar and transverse to and extend radially outward from the central axis, ii. wherein each of the tab elements includes at its distal tab end, a capture bend region, whereby the tab axis of a distal portion of the tab element extends from an intermediate point, away from the principal plane in a first direction, and thereafter extends toward and across the principal plane in a second direction to the distal tab end, iii. wherein each of the tab elements includes a primary bend region between its proximal portion and the intermediate point, whereby a distal portion of the tab element extending from the intermediate point to the distal tab end extends transverse to the tab axis in a direction perpendicular to the principal plane, between a first lateral edge on one side of the principal plane and a second lateral edge on the other side of the principal plane, and wherein each distal portion includes a slot having a predetermined width W extending from the first lateral edge into the distal portion along an associated slot axis parallel to and a distance S from the central axis.

2. An anchor element according to claim 1, further including a structure for coupling the coupling region to an externally applied element.

3. An anchor element according to claim 1, wherein the tab elements are equi-angularly disposed about the central axis.

4. An anchor and support assembly kit, comprising:

A. an upper clamp element, wherein the clamp element is a sheet element having a uniform thickness D, and having a planar central portion having a nominal periphery P, and extending along and about a principal plane transverse to a central axis, wherein the sheet element has:

i. a coupling region disposed about the central axis and within the central portion, ii. at least three elongated tab elements, each tab element extending along an associated tab axis from the nominal periphery P, from a proximal portion at a proximal end thereof to a distal end, wherein a principal plane of the proximal portion extends along and is parallel to the principal plane, a. wherein the tab axes are co-planar and are transverse to and extend radially outward from the central axis, and are equi-angularly disposed about the central axis, b. wherein each of the tab elements includes at its tab distal end, a capture bend region, whereby the tab axis of a distal portion of the tab element extends from an intermediate point, away from the principal plane in a first direction, and thereafter extends toward and across the principal plane in a second direction to the distal end, c. wherein each of the tab elements includes a primary bend region between its proximal portion and the intermediate point, whereby a distal portion extending from the intermediate point to the tab distal end, extends transverse to the tab axis in a direction perpendicular to the principal plane, between a first lateral edge on one side of the principal plane and a second lateral edge on the other side of the principal plane, and d. wherein each distal portion includes a slot having a predetermined width W extending from the first lateral edge into the distal portion along an associated slot axis parallel to and a distance S from the central axis, B. a lower clamp element, wherein the clamp element is a sheet element having a uniform thickness D, and having a planar central portion having a nominal periphery P, and extending along and about a principal plane transverse to a central axis, wherein the sheet element has:

i. a coupling region disposed about the central axis and within the central portion, ii. at least three elongated tab elements, each tab element extending along an associated tab axis from the nominal periphery P, from a proximal portion at a proximal end thereof to a tab distal end, wherein a principal plane of the proximal portion extends along and is parallel to the principal plane, a. wherein the tab axes are co-planar and are transverse to and extend radially outward from the central axis, and are equi-angularly disposed about the central axis, b. wherein each of the tab elements includes at its tab distal end, a capture bend region, whereby the tab axis of a distal portion of the tab element extend from an intermediate point, away from the principal plane in a first direction, and thereafter extends toward and across the principal plane in a second direction to the tab distal end, c. wherein each of the tab elements includes a primary bend region between its proximal portion and the intermediate point, whereby a distal portion extending from the intermediate point to the distal end, extends transverse to the tab axis in a direction perpendicular to the principal plane, between a first lateral edge on one side of the principal plane and a second lateral edge on the other side of the principal plane, and d. wherein each distal portion includes a slot having a predetermined width W extending from the first lateral edge into the distal portion along an associated slot axis parallel to and a distance S from the central axis, C. a set of fastening elements adapted to secure the upper clamp plate to the lower clamp element with distal portions of opposite tab elements disposed within corresponding slots, and D. a set of elongated stake elements, each stake element being associated with a tab element, and wherein each stake element extends from a stake proximal end to a stake distal end, wherein the stake proximal end is adapted for capture between oppositely positioned bend regions of the upper clamp element and the lower clamp element when positioned opposite each other with the fastening elements.

* * * * *